US009892876B2

(12) United States Patent
Bandringa

(10) Patent No.: US 9,892,876 B2
(45) Date of Patent: Feb. 13, 2018

(54) TACTILE SWITCH FOR A MOBILE ELECTRONIC DEVICE

(71) Applicant: Hand Held Products, Inc., Fort Mill, SC (US)

(72) Inventor: John Spencer Bandringa, Everett, WA (US)

(73) Assignee: Hand Held Products, Inc., Fort Mill, SC (US)

( * ) Notice: Subject to any disclaimer, the term of this patent is extended or adjusted under 35 U.S.C. 154(b) by 119 days.

(21) Appl. No.: 14/740,320

(22) Filed: Jun. 16, 2015

(65) Prior Publication Data

US 2016/0372282 A1 Dec. 22, 2016

(51) Int. Cl.
*H01H 35/24* (2006.01)
*H01H 35/30* (2006.01)
(Continued)

(52) U.S. Cl.
CPC ..... *H01H 35/245* (2013.01); *H01H 35/30* (2013.01); *H01H 35/34* (2013.01);
(Continued)

(58) Field of Classification Search
CPC ..... H01H 35/26; H01H 2215/05; H01H 2221/038; H01H 1/00; H01H 1/02; H01H 3/00; H01H 3/02; H01H 3/12; H01H 13/00; H01H 13/02; H01H 13/14; H01H 13/20; H01H 13/26; H01H 13/5078; H01H 35/18;
(Continued)

(56) References Cited

U.S. PATENT DOCUMENTS 6,832,725 B2 12/2004 Gardiner et al.
7,128,266 B2 10/2006 Marlton et al.
(Continued)

FOREIGN PATENT DOCUMENTS

JP 2009-053857 A 3/2009
WO 2006/000749 A1 1/2006
(Continued)

OTHER PUBLICATIONS

Combined Search and Examination Report in counterpart UK Application No. GB1610258.4 dated Oct. 28, 2016, pp. 1-11.
(Continued)

*Primary Examiner* — Anthony R. Jimenez
(74) *Attorney, Agent, or Firm* — Additon, Higgins & Pendleton, P.A.

(57) ABSTRACT

A tactile switch on a mobile electronic device having a housing is provided. The tactile switch is comprised of a pressure sensitive interface on an exterior portion of the housing, a switch mechanism, and at least one pathway coupled to the pressure sensitive interface and extending from the pressure sensitive interface to the switch mechanism. The switch mechanism is at a remote location from the pressure sensitive interface. The pathway is formed in an interior portion of the housing. The tactile switch further includes a viscous fluid substantially filling the pathway. The tactile switch is configured such that when pressure is applied to the pressure sensitive interface, the viscous fluid exerts pressure on the switch mechanism, causing the switch to make an electrical contact.

20 Claims, 4 Drawing Sheets

(51) Int. Cl.
*H01H 35/34* (2006.01)
*H01H 13/20* (2006.01)

(52) U.S. Cl.
CPC ..... *H01H 13/20* (2013.01); *H01H 2215/05* (2013.01); *H01H 2221/038* (2013.01); *H01H 2231/022* (2013.01)

(58) Field of Classification Search
CPC .... H01H 35/24; H01H 35/242; H01H 35/245; H01H 35/30; H01H 35/34; H01H 35/36; H01H 2003/12
USPC ..... 200/81 H, 51 R, 61.25, DIG. 41
See application file for complete search history.

(56) References Cited

U.S. PATENT DOCUMENTS 7,159,783 B2 1/2007 Walczyk et al.
7,413,127 B2 8/2008 Ehrhart et al.
7,726,575 B2 6/2010 Wang et al.
8,174,372 B2 * 5/2012 da Costa ..... G06F 3/016 340/407.1
8,294,969 B2 10/2012 Plesko
8,317,105 B2 11/2012 Kotlarsky et al.
8,322,622 B2 12/2012 Suzhou et al.
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Van Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,736,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.
8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Bremer et al.
8,870,074 B1 10/2014 Gannon
8,879,639 B2 11/2014 Sauerwein

(56) References Cited

U.S. PATENT DOCUMENTS 8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
D733,112 S 6/2015 Chaney et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,082,023 B2 7/2015 Feng et al.
2007/0063048 A1 3/2007 Havens et al.
2008/0068224 A1 3/2008 Holland
2009/0134221 A1 5/2009 Zhu et al.
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193211 A1 8/2012 Ciesla et al.
2012/0193423 A1 8/2012 Samek
2012/0203647 A1 8/2012 Smith
2012/0223141 A1 9/2012 Good et al.
2012/0223824 A1* 9/2012 Rothkopf ..... G06F 3/016 340/407.1
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0287258 A1 10/2013 Kearney
2013/0292237 A1* 11/2013 Arai ..... G06F 3/0202 200/5 A
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedrao
2013/0307964 A1 11/2013 Bremer et al.
2013/0308625 A1 11/2013 Corcoran
2013/0313324 A1 11/2013 Koziol et al.
2013/0313325 A1 11/2013 Wilz et al.
2013/0342717 A1 12/2013 Havens et al.
2014/0001267 A1 1/2014 Giordano et al.
2014/0002828 A1 1/2014 Laffargue et al.
2014/0008439 A1 1/2014 Wang
2014/0025584 A1 1/2014 Liu et al.
2014/0034734 A1 2/2014 Sauerwein
2014/0036848 A1 2/2014 Pease et al.
2014/0039693 A1 2/2014 Havens et al.
2014/0042814 A1 2/2014 Kather et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078341 A1 3/2014 Havens et al.
2014/0078342 A1 3/2014 Li et al.
2014/0078345 A1 3/2014 Showering
2014/0098792 A1 4/2014 Wang et al.
2014/0100774 A1 4/2014 Showering
2014/0100813 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Li et al.
2014/0104451 A1 4/2014 Todeschini et al.
2014/0106594 A1 4/2014 Skvoretz
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0121438 A1 5/2014 Kearney
2014/0121445 A1 5/2014 Ding et al.
2014/0124577 A1 5/2014 Wang et al.
2014/0124579 A1 5/2014 Ding

(56) References Cited

U.S. PATENT DOCUMENTS

2014/0125842 A1 5/2014 Winegar
2014/0125853 A1 5/2014 Wang
2014/0125999 A1 5/2014 Longacre et al.
2014/0129378 A1 5/2014 Richardson
2014/0131441 A1 5/2014 Nahill et al.
2014/0131443 A1 5/2014 Smith
2014/0131444 A1 5/2014 Wang
2014/0131448 A1 5/2014 Xian et al.
2014/0133379 A1 5/2014 Wang et al.
2014/0136208 A1 5/2014 Maltseff et al.
2014/0140585 A1 5/2014 Wang
2014/0151453 A1 6/2014 Meier et al.
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0175172 A1 6/2014 Jovanovski et al.
2014/0191644 A1 7/2014 Chaney
2014/0191913 A1 7/2014 Ge et al.
2014/0197238 A1 7/2014 Lui et al.
2014/0197239 A1 7/2014 Havens et al.
2014/0197304 A1 7/2014 Feng et al.
2014/0203087 A1 7/2014 Smith et al.
2014/0204268 A1 7/2014 Grunow et al.
2014/0214631 A1 7/2014 Hansen
2014/0217166 A1 8/2014 Berthiaume et al.
2014/0217180 A1 8/2014 Liu
2014/0231500 A1 8/2014 Ehrhart et al.
2014/0232930 A1 8/2014 Anderson
2014/0247315 A1 9/2014 Marty et al.
2014/0248958 A1 9/2014 Yamagishi
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0284384 A1 9/2014 Lu et al.
2014/0288933 A1 9/2014 Braho et al.
2014/0297058 A1 10/2014 Barker et al.
2014/0299665 A1 10/2014 Barber et al.
2014/0312121 A1 10/2014 Lu et al.
2014/0319220 A1 10/2014 Coyle
2014/0319221 A1 10/2014 Oberpriller et al.
2014/0326787 A1 11/2014 Barten
2014/0332590 A1 11/2014 Wang et al.
2014/0344943 A1 11/2014 Todeschini et al.
2014/0346233 A1 11/2014 Liu et al.
2014/0351317 A1 11/2014 Smith et al.
2014/0353373 A1 12/2014 Van Horn et al.
2014/0361073 A1 12/2014 Qu et al.
2014/0361082 A1 12/2014 Xian et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0001304 A1 1/2015 Todeschini
2015/0003673 A1 1/2015 Fletcher
2015/0009338 A1 1/2015 Laffargue et al.
2015/0009610 A1 1/2015 London et al.
2015/0014416 A1 1/2015 Kotlarsky et al.
2015/0021397 A1 1/2015 Rueblinger et al.
2015/0028102 A1 1/2015 Ren et al.
2015/0028103 A1 1/2015 Jiang
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0048168 A1 2/2015 Fritz et al.
2015/0049347 A1 2/2015 Laffargue et al.
2015/0051992 A1 2/2015 Smith
2015/0053766 A1 2/2015 Havens et al.
2015/0053768 A1 2/2015 Wang et al.
2015/0053769 A1 2/2015 Thuries et al.
2015/0062366 A1 3/2015 Liu et al.
2015/0063215 A1 3/2015 Wang
2015/0063676 A1 3/2015 Lloyd et al.
2015/0069130 A1 3/2015 Gannon
2015/0071818 A1 3/2015 Todeschini
2015/0083800 A1 3/2015 Li et al.
2015/0086114 A1 3/2015 Todeschini
2015/0088522 A1 3/2015 Hendrickson et al.
2015/0096872 A1 4/2015 Woodburn
2015/0099557 A1 4/2015 Pettinelli et al.
2015/0100196 A1 4/2015 Hollifield
2015/0102109 A1 4/2015 Huck
2015/0115035 A1 4/2015 Meier et al.
2015/0127791 A1 5/2015 Kosecki et al.
2015/0128116 A1 5/2015 Chen et al.
2015/0129659 A1 5/2015 Feng et al.
2015/0133047 A1 5/2015 Smith et al.
2015/0134470 A1 5/2015 Hejl et al.
2015/0136851 A1 5/2015 Harding et al.
2015/0136854 A1 5/2015 Lu et al.
2015/0142492 A1 5/2015 Kumar
2015/0144692 A1 5/2015 Hejl
2015/0144698 A1 5/2015 Teng et al.
2015/0144701 A1 5/2015 Xian et al.
2015/0149946 A1 5/2015 Benos et al.
2015/0161429 A1 6/2015 Xian
2015/0169925 A1 6/2015 Chang et al.
2015/0169929 A1 6/2015 Williams et al.
2015/0186703 A1 7/2015 Chen et al.
2015/0193644 A1 7/2015 Kearney et al.
2015/0193645 A1 7/2015 Colavito et al.
2015/0199957 A1 7/2015 Funyak et al.
2015/0204671 A1 7/2015 Showering
2015/0378435 A1 12/2015 Ciesla et al.
2016/0217946 A1 7/2016 Maggiore

FOREIGN PATENT DOCUMENTS

WO 2012/054781 A1 4/2012
WO 2013163789 A1 11/2013
WO 2013173985 A1 11/2013
WO 2014019130 A1 2/2014
WO 2014110495 A1 7/2014
WO 2016/119801 A1 8/2016

OTHER PUBLICATIONS

U.S. Appl. No. 14/519,179 for Dimensioning System With Multipath Interference Mitigation filed Oct. 21, 2014 (Thuries et al.); 30 pages.
U.S. Appl. No. 14/264,173 for Autofocus Lens System for Indicia Readers filed Apr. 29, 2014, (Ackley et al.); 39 pages.
U.S. Appl. No. 14/453,019 for Dimensioning System With Guided Alignment, filed Aug. 6, 2014 (Li et al.); 31 pages.
U.S. Appl. No. 14/452,697 for Interactive Indicia Reader , filed Aug. 6, 2014, (Todeschini); 32 pages.
U.S. Appl. No. 14/231,898 for Hand-Mounted Indicia-Reading Device with Finger Motion Triggering filed Apr. 1, 2014 (Van Horn et al.); 36 pages.
U.S. Appl. No. 14/715,916 for Evaluating Image Values filed May 19, 2015 (Ackley); 60 pages.
U.S. Appl. No. 14/513,808 for Identifying Inventory Items in a Storage Facility filed Oct. 14, 2014 (Singel et al.); 51 pages.
U.S. Appl. No. 29/458,405 for an Electronic Device, filed Jun. 19, 2013 (Fitch et al.); 22 pages.
U.S. Appl. No. 29/459,620 for an Electronic Device Enclosure, filed Jul. 2, 2013 (London et al.); 21 pages.
U.S. Appl. No. 14/483,056 for Variable Depth of Field Barcode Scanner filed Sep. 10, 2014 (McCloskey et al.); 29 pages.

(56) References Cited

OTHER PUBLICATIONS

U.S. Appl. No. 14/531,154 for Directing an Inspector Through an Inspection filed Nov. 3, 2014 (Miller et al.); 53 pages.
U.S. Appl. No. 29/525,068 for Tablet Computer With Removable Scanning Device filed Apr. 27, 2015 (Schulte et al.); 19 pages.
U.S. Appl. No. 29/468,118 for an Electronic Device Case, filed Sep. 26, 2013 (Oberpriller et al.); 44 pages.
U.S. Appl. No. 14/340,627 for an Axially Reinforced Flexible Scan Element, filed Jul. 25, 2014 (Reublinger et al.); 41 pages.
U.S. Appl. No. 14/676,327 for Device Management Proxy for Secure Devices filed Apr. 1, 2015 (Yeakley et al.); 50 pages.
U.S. Appl. No. 14/257,364 for Docking System and Method Using Near Field Communication filed Apr. 21, 2014 (Showering); 31 pages.
U.S. Appl. No. 14/327,827 for a Mobile-Phone Adapter for Electronic Transactions, filed Jul. 10, 2014 (Hejl); 25 pages.
U.S. Appl. No. 14/334,934 for a System and Method for Indicia Verification, filed Jul. 18, 2014 (Hejl); 38 pages.
U.S. Appl. No. 29/530,600 for Cyclone filed Jun. 18, 2015 (Vargo et al); 16 pages.
U.S. Appl. No. 14/707,123 for Application Independent DEX/UCS Interface filed May 8, 2015 (Pape); 47 pages.
U.S. Appl. No. 14/283,282 for Terminal Having Illumination and Focus Control filed May 21, 2014 (Liu et al.); 31 pages.
U.S. Appl. No. 14/619,093 for Methods for Training a Speech Recognition System filed Feb. 11, 2015 (Pecorari); 35 pages.
U.S. Appl. No. 29/524,186 for Scanner filed Apr. 17, 2015 (Zhou et al.); 17 pages.
U.S. Appl. No. 14/705,407 for Method and System to Protect Software-Based Network-Connected Devices From Advanced Persistent Threat filed May 6, 2015 (Hussey et al.); 42 pages.
U.S. Appl. No. 14/614,706 for Device for Supporting an Electronic Tool on a User's Hand filed Feb. 5, 2015 (Oberpriller et al.); 33 pages.
U.S. Appl. No. 14/628,708 for Device, System, and Method for Determining the Status of Checkout Lanes filed Feb. 23, 2015 (Todeschini); 37 pages.
U.S. Appl. No. 14/704,050 for Intermediate Linear Positioning filed May 5, 2015 (Charpentier et al.); 60 pages.
U.S. Appl. No. 14/529,563 for Adaptable Interface for a Mobile Computing Device filed Oct. 31, 2014 (Schoon et al.); 36 pages.
U.S. Appl. No. 14/705,012 for Hands-Free Human Machine Interface Responsive to a Driver of a Vehicle filed May 6, 2015 (Fitch et al.); 44 pages.
U.S. Appl. No. 14/715,672 for Augumented Reality Enabled Hazard Display filed May 19, 2015 (Venkatesha et al.); 35 pages.
U.S. Appl. No. 14/695,364 for Medication Management System filed Apr. 24, 2015 (Sewell et al.); 44 pages.
U.S. Appl. No. 14/664,063 for Method and Application for Scanning a Barcode With a Smart Device While Continuously Running and Displaying an Application on the Smart Device Display filed Mar. 20, 2015 (Todeschini); 37 pages.
U.S. Appl. No. 14/735,717 for Indicia-Reading Systems Having an Interface With a User's Nervous System filed Jun. 10, 2015 (Todeschini); 39 pages.
U.S. Appl. No. 141527,191 for Method and System for Recognizing Speech Using Wildcards in an Expected Response filed Oct. 29, 2014 (Braho et al.); 45 pages.
U.S. Appl. No. 14/702,110 for System and Method for Regulating Barcode Data Injection Into a Running Application on a Smart Device filed May 1, 2015 (Todeschini et al.); 38 pages.
U.S. Appl. No. 14/535,764 for Concatenated Expected Responses for Speech Recognition filed Nov. 7, 2014 (Braho et al.); 51 pages.
U.S. Appl. No. 14/687,289 for System for Communication Via a Peripheral Hub filed Apr. 15, 2015 (Kohtz et al.); 37 pages.
U.S. Appl. No. 14/747,197 for Optical Pattern Projector filed Jun. 23, 2015 (Thuries et al.); 33 pages.
U.S. Appl. No. 14/674,329 for Aimer for Barcode Scanning filed Mar. 31, 2015 (Bidwell); 36 pages.
U.S. Appl. No. 14/702,979 for Tracking Battery Conditions filed May 4, 2015 (Young et al.); 70 pages.
U.S. Appl. No. 29/529,441 for Indicia Reading Device filed Jun. 8, 2015 (Zhou et al.); 14 pages.
U.S. Appl. No. 14/747,490 for Dual-Projector Three-Dimensional Scanner filed Jun. 23, 2015 (Jovanovski et al.); 40 pages.
U.S. Appl. No. 14/740,320 for Tactile Switch for a Mobile Electronic Device filed Jun. 16, 2015 (Barndringa); 38 pages.
U.S. Appl. No. 14/695,923 for Secure Unattended Network Authentication filed Apr. 24, 2015 (Kubler et al.); 52 pages.
U.S. Appl. No. 14/740,373 for Calibrating a Volume Dimensioner filed Jun. 16, 2015 (Ackley et al.); 63 pages.
U.S. Appl. No. 13/367,978, filed Feb. 7, 2012, (Feng et al.); now abandoned.
U.S. Appl. No. 14/462,801 for Mobile Computing Device With Data Cognition Software, filed Aug. 19, 2014 (Todeschini et al.); 38 pages.
U.S. Appl. No. 14/596,757 for System and Method for Detecting Barcode Printing Errors filed Jan. 14, 2015 (Ackley); 41 pages.
U.S. Appl. No. 14/277,337 for Multipurpose Optical Reader, filed May 14, 2014 (Jovanovski et al.); 59 pages.
U.S. Appl. No. 14/200,405 for Indicia Reader for Size-Limited Applications filed Mar. 7, 2014 (Feng et al.); 42 pages.
U.S. Appl. No. 14/662,922 for Multifunction Point of Sale System filed Mar. 19, 2015 (Van Horn et al.); 41 pages.
U.S. Appl. No. 14/446,391 for Multifunction Point of Sale Apparatus With Optical Signature Capture filed Jul. 30, 2014 (Good et al.); 37 pages.
U.S. Appl. No. 29/528,165 for In-Counter Barcode Scanner filed May 27, 2015 (Oberpriller et al.); 13 pages.
U.S. Appl. No. 29/528,890 for Mobile Computer Housing filed Jun. 2, 2015 (Fitch et al.); 61 pages.
U.S. Appl. No. 14/614,796 for Cargo Apportionment Techniques filed Feb. 5, 2015 (Morton et al.); 56 pages.
U.S. Appl. No. 29/516,892 for Table Computer filed Feb. 6, 2015 (Bidwell et al.); 13 pages.
U.S. Appl. No. 29/523,098 for Handle for a Tablet Computer filed Apr. 7, 2015 (Birdwell et al.); 17 pages.
U.S. Appl. No. 14/578,627 for Safety System and Method filed Dec. 22, 2014 (Ackley et al.); 32 pages.
U.S. Appl. No. 14/573,022 for Dynamic Diagnostic Indicator Generation filed Dec. 17, 2014 (Goldsmith); 43 pages.
U.S. Appl. No. 14/529,857 for Barcode Reader With Security Features filed Oct. 31, 2014 (Todeschini et al.); 32 pages.
U.S. Appl. No. 14/519,195 for Handheld Dimensioning System With Feedback filed Oct. 21, 2014 (Laffargue et al.); 39 pages.
U.S. Appl. No. 14/519,211 for System and Method for Dimensioning filed Oct. 21, 2014 (Ackley et al.); 33 pages.
U.S. Appl. No. 14/519,233 for Handheld Dimensioner With Data-Quality Indication filed Oct. 21, 2014 (Laffargue et al.); 36 pages.
U.S. Appl. No. 14/533,319 for Barcode Scanning System Using Wearable Device With Embedded Camera filed Nov. 5, 2014 (Todeschini); 29 pages.
U.S. Appl. No. 14/748,446 for Cordless Indicia Reader With a Multifunction Coil for Charging and EAS Deactivation, filed Jun. 24, 2015 (Xie et al.); 34 pages.
U.S. Appl. No. 29/528,590 for Electronic Device filed May 29, 2015 (Fitch et al.); 9 pages.
U.S. Appl. No. 14/519,249 for Handheld Dimensioning System With Measurement-Conformance Feedback filed Oct. 21, 2014 (Ackley et al.); 36 pages.
U.S. Appl. No. 29/519,017 for Scanner filed Mar. 2, 2015 (Zhou et al.); 11 pages.
U.S. Appl. No. 14/398,542 for Portable Electronic Devices Having a Seperate Location Trigger Unit for Use in Controlling an Application Unit filed Nov. 3, 2014 (Bian et al.); 22 pages.
U.S. Appl. No. 14/405,278 for Design Pattern for Secure Store filed Mar. 9, 2015 (Zhu et al.); 23 pages.
U.S. Appl. No. 14/590,024 for Shelving and Package Locating Systems for Delivery Vehicles filed Jan. 6, 2015 (Payne); 31 pages.
U.S. Appl. No. 14/568,305 for Auto-Contrast Viewfinder for an Indicia Reader filed Dec. 12, 2014 (Todeschini); 29 pages.

(56) References Cited

OTHER PUBLICATIONS

U.S. Appl. No. 29/526,918 for Charging Base filed May 14, 2015 (Fitch et al.); 10 pages.
U.S. Appl. No. 14/580,262 for Media Gate for Thermal Transfer Printers filed Dec. 23, 2014 (Bowles); 36 pages.

* cited by examiner

TACTILE SWITCH FOR A MOBILE ELECTRONIC DEVICE

FIELD OF THE INVENTION

The present invention relates to mobile electronic devices such as smart phones and handheld computers, and particularly to button switches on such devices.

BACKGROUND

Generally speaking as electronic devices become more mobile, portable, and smaller, these handheld electronic devices employ touch screens and touch gestures to operate features of the device. However, the need for traditional tactile button, or mechanical approach has not completely been eliminated.

Implementing traditional mechanical approach presents challenges. Often, an electronic device's internal components are competing for space which makes the mechanical approach particularly difficult to implement. The positioning of the input tactile buttons can lead to additional challenges such as RF interference or decreased durability.

Therefore, a need exists for tactile buttons for human input on handheld and portable electronic devices which have flexible positioning with respect to the switch or operation of the button controls, and which are efficient in the space they occupy within the device.

SUMMARY

Accordingly, in one aspect, the present invention embraces a tactile switch on a mobile electronic device.

In an exemplary embodiment, a tactile switch on a mobile electronic device having a housing, includes a pressure sensitive interface on an exterior portion of the housing, a switch mechanism, and at least one pathway coupled to the pressure sensitive interface and extending from the pressure sensitive interface to the switch mechanism. The switch mechanism is at a remote location from the pressure sensitive interface. The pathway is formed in an interior portion of the housing. Additionally, a viscous fluid substantially fills the pathway. The tactile switch is configured such that when pressure is applied to the pressure sensitive interface, the viscous fluid in the pathway exerts pressure on the switch mechanism, causing the switch to make an electrical contact.

In another exemplary embodiment, the switch mechanism is mechanical.

In another exemplary embodiment, the switch mechanism is a solid state pressure sensor.

In another exemplary embodiment, the pressure sensitive interface is differentially sensitive to different pressures applied to the pressure sensitive interface.

In yet another exemplary embodiment of the invention, the pathway is molded into the interior portion of the housing.

In another exemplary embodiment, the viscous fluid is a hydraulic fluid.

In another exemplary embodiment, the pressure sensitive interface is comprised of more than one pressure sensitive interface. The at least one pathway is comprised of one pathway corresponding to each pressure sensitive interface. The tactile switch further comprises additional switch mechanisms corresponding to each pressure sensitive interface.

In another exemplary embodiment, the pressure sensitive interface may be located on any part of the exterior portion of the housing.

In another exemplary embodiment, the pressure sensitive interface has a shape. The shape conforms to a contour of the exterior portion of the housing where the pressure sensitive interface is located.

In yet another exemplary embodiment of the invention, the tactile switch further comprises means to transmit vibration to the exterior housing when the electrical contact is made with the switch mechanism.

In another exemplary embodiment of the invention, the vibration is transmitted to the pressure sensitive interface.

In another exemplary embodiment, the means to transmit vibration is selected from a solenoid and a vibrator, the means being activated by the switch making the electrical contact.

In another exemplary embodiment of the invention, the pathways are sealed.

In yet another exemplary embodiment of the invention, the pressure sensitive interface is directionally sensitive to pressure. The at least one pathway is comprised of one pathway corresponding to each direction in which the pressure sensitive interface is directionally sensitive. The tactile switch further comprises additional switch mechanisms corresponding to each pathway.

In another exemplary embodiment of the invention, the tactile switch further comprises means to transmit vibrations to the exterior housing when the electrical contact is made with one of the switch mechanisms. The vibrations are varied in property depending on which switch mechanism caused the electrical contact.

In another exemplary embodiment of the invention, the vibration property is selected from amplitude and frequency.

In another exemplary embodiment of the invention, the exterior portion of the housing of the mobile electronic device is comprised of a resilient material. The pressure sensitive interface is comprised of the entire exterior portion of the housing.

In another aspect, the present invention embraces a tactile switch on a mobile electronic device having a housing; the tactile switch comprising a pressure sensitive interface on an exterior portion of the housing, a switch mechanism, and means for transferring pressure from the pressure sensitive interface to the switch mechanism such that pressure applied to the pressure sensitive interface causes the switch mechanism to make an electrical contact via the means for transferring pressure. The switch mechanism is at a remote location from the pressure sensitive interface.

In another exemplary embodiment, the means for transferring pressure comprises at least one pathway coupled to the pressure sensitive interface and extending from the pressure sensitive interface to the switch mechanism. The pathway is formed in an interior portion of the housing. The means further comprises viscous fluid substantially filling the pathway.

In another exemplary embodiment, the tactile switch further comprises a reservoir containing the viscous fluid. The reservoir is located between the pressure sensitive interface and the pathway.

The foregoing illustrative summary, as well as other exemplary objectives and/or advantages of the invention, and the manner in which the same are accomplished, are further explained within the following detailed description and its accompanying drawings.

DETAILED DESCRIPTION

Figure 1:
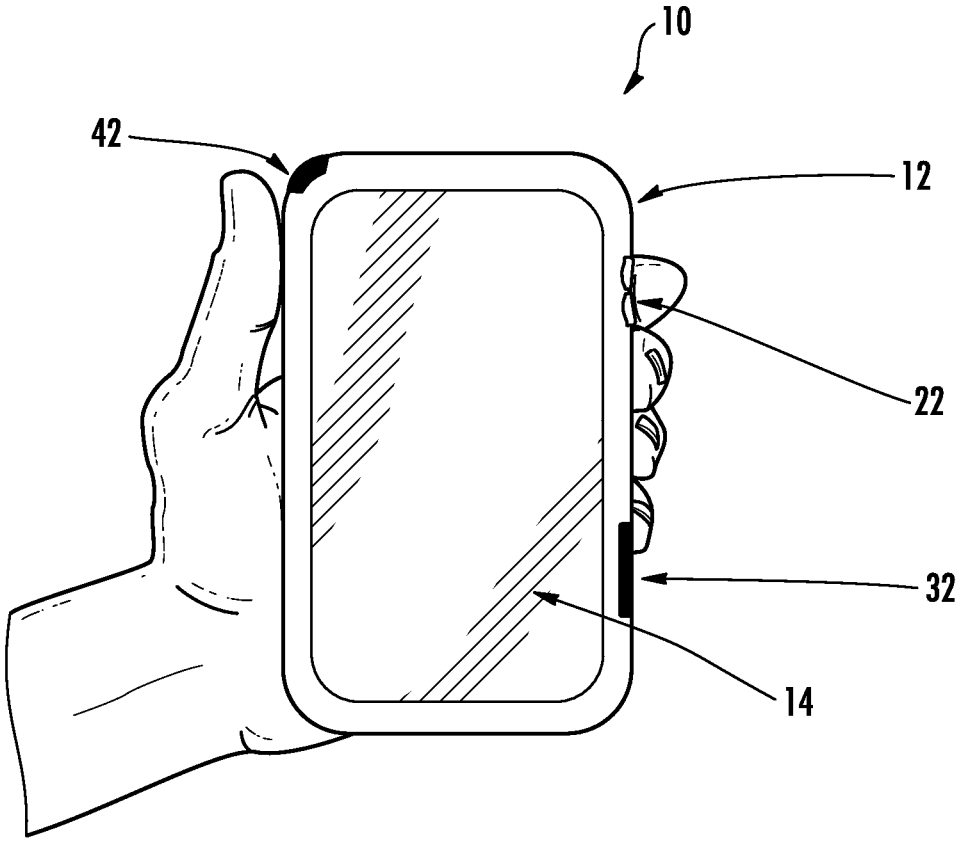
FIG. 1 schematically depicts a mobile device with three tactile switches in accordance with an exemplary embodiment of the present invention.

The present invention embraces a tactile switch for an electronic mobile device. FIG. 1 illustrates a mobile electronic device with three tactile switches in accordance with the present invention.

In an exemplary embodiment, referring to FIG. 1, a mobile electronic device (10) is provided with a housing (12) and a touchscreen (14). Pressure sensitive interfaces (22, 32, and 42) for tactile switches according to the present invention are provided as part of the housing or on an exterior portion of the housing (12). For example, pressure sensitive interface (42) is shaped to the contour of the housing of the mobile electronic device (10). Pressure sensitive interface (32) is flush with the housing (12) of the mobile electronic device (10). Pressure sensitive interface (22) is slightly elevated from the housing (12) of the mobile electronic device (10). The pressure sensitive interfaces (32) and (22) will be discussed in more detail in conjunction with FIGS. 2 and 3 respectively below. The housing (12) and the pressure sensitive interfaces (22, 32, 42) may be made of resilient material.

Figure 2A:
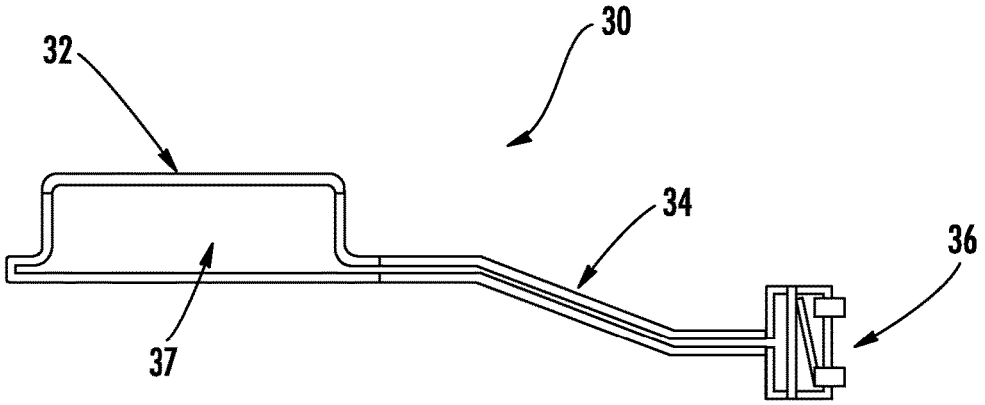
FIGS. 2*a* and 2*b* schematically depict a tactile switch in an inactivated state and in an activated state respectively in accordance with an exemplary embodiment of the present invention.

Referring now to FIG. 2*a*, in an exemplary embodiment of the present invention, the tactile switch (30) is comprised of a pressure sensitive interface (32), a switch mechanism (36) at a remote location from the pressure sensitive interface (32), and a pathway (34) coupled to the pressure sensitive interface (32) and extending from the pressure sensitive interface (32) to the switch mechanism (36). A reservoir (37) is provided between the pressure sensitive interface (32) and the pathway (34). The pathway (34) is formed in an interior portion of the housing. For example, the pathway may be etched or molded into a plastic housing of the mobile electronic device. Alternatively the pathway could be molded in another interior parts of the mobile device, thus saving valuable real estate.

Figure 2B:
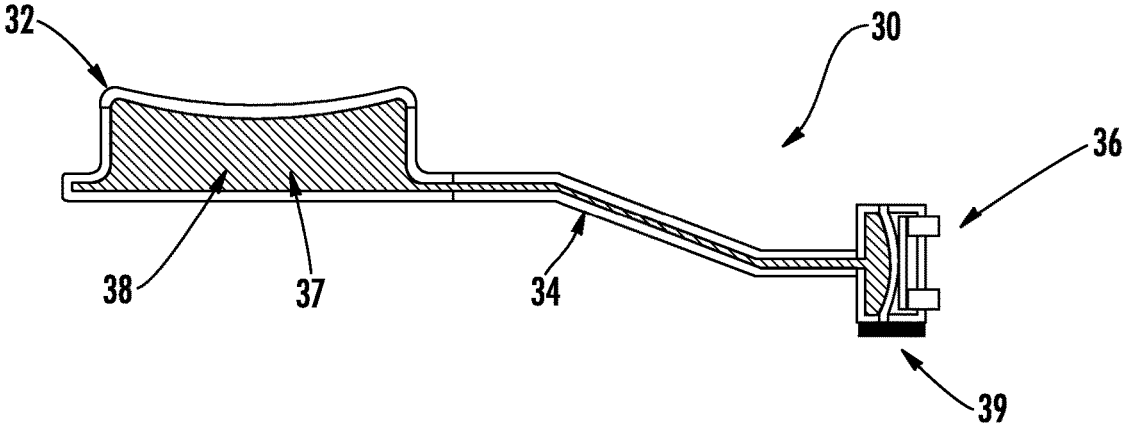

Referring to FIG. 2*b*, in an exemplary embodiment, viscous fluid (38) fills the reservoir (37) and the pathway (34). In the Figure, the pressure sensitive interface (32) is shown as being depressed, which causes the viscous fluid (38) to exert pressure on the switch mechanism (36), causing the switch mechanism (36) to make an electrical contact.

In another exemplary embodiment, the tactile switch (30) also includes a vibration device (39). The vibration device (39), for example, may be a solenoid or a vibrator. The vibration device (39) is activated when the switch mechanism (36) makes an electrical contact. The vibration device (39) may be mechanically coupled to the pathway (34) such that vibration is transmitted to the pressure sensitive interface (32).

Figure 3A:
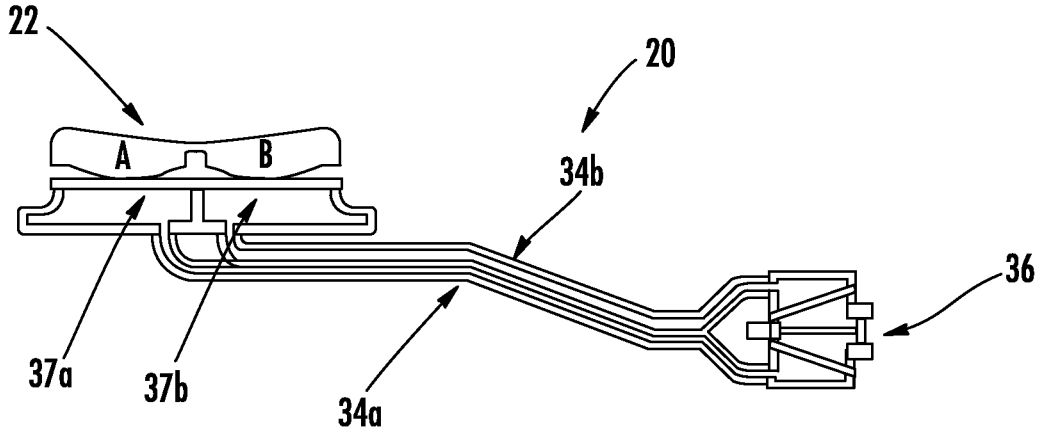
FIGS. 3*a* and 3*b* schematically depict another tactile switch in an inactivated state and in an activated state respectively in accordance with another exemplary embodiment of the present invention.

Referring now to FIG. 3*a*, tactile switch (20) is schematically shown. In an exemplary embodiment, tactile switch (20) is comprised of pressures sensitive interface (22), reservoirs (37*a* and 37*b*), pathways (34*a* and 34*b*), corresponding to reservoirs (37*a* and 37*b*), and switch mechanism (36). In the exemplary embodiment, the pressure sensitive interface (22) is actually comprised of two pressure sensitive interfaces (22*a* and 22*b*). Thus, tactile switch (20) is actually two switches or a switch with dual functions.

Figure 3B:
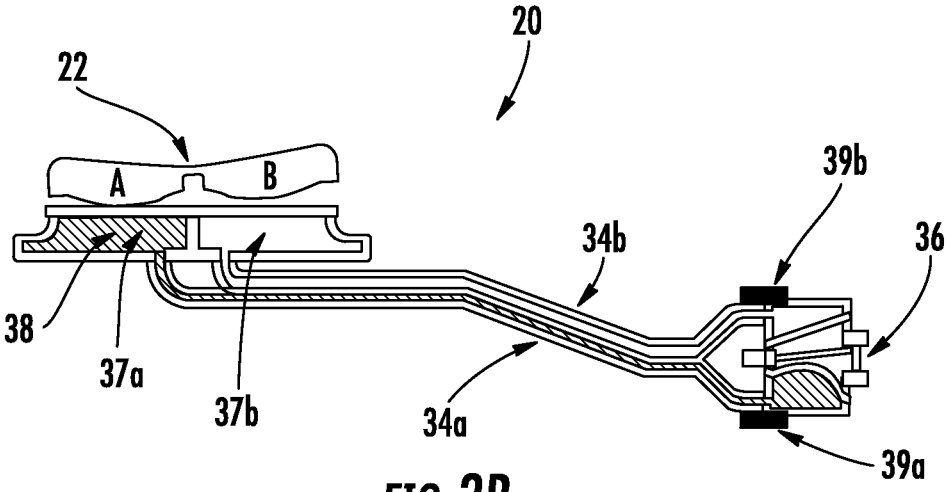

In another exemplary embodiment, referring to FIG. 3*b*, pressure sensitive interface (22*a*) is depressed. Viscous fluid (38) in reservoir (37*a*) is forced down pathway (34*a*) to exert pressure on switch mechanism (36). The pathways (34*a* and 34*b*) may be formed in an interior portion of the housing. For example, the pathways (34*a* and 34*b*) may be etched or molded into a plastic housing of the mobile electronic device. Alternatively the pathways (34*a* and 34*b*) could be molded in other interior parts of the mobile device, thus saving valuable real estate.

In another exemplary embodiment, the tactile switch (20) is provided with vibration devices (39*a* and 39*b*). The vibration devices (39*a* and 39*b*), for example may be solenoids or vibrators. One of the vibration devices (39*a* or 39*b*) is activated when the switch mechanism (36) makes an electrical contact, depending on whether pressure sensitive interface (22*a* or 22*b*) is depressed. The vibration devices (39*a* or 39*b*) may be mechanically coupled to the pathways (34*a* and 34*b*) such that vibration is transmitted to the corresponding pressure sensitive interface (22*a* or 22*b*).

In another exemplary embodiment, the vibrations are varied in property depending on which pressure sensitive interface (22*a* or 22*b*) is depressed. The property variation can be one of frequency or amplitude, which is transmitted to the pressure sensitive interface (22*a* or 22*b*) via the viscous fluid (38) in the corresponding pathway (34*a* or 34*b*).

Figure 4A:
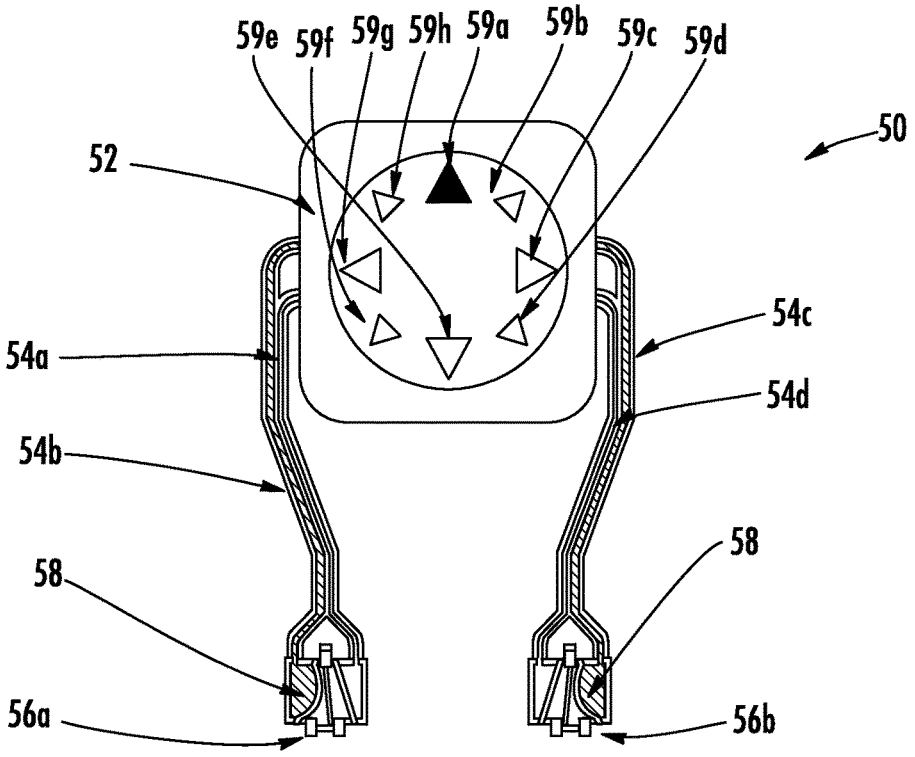
FIGS. 4*a* and 4*b* schematically depict a further tactile switch in an inactivated state and in an activated state respectively in accordance with another exemplary embodiment of the present invention.

In another exemplary embodiment, the tactile switch's pressure sensitive interface is directionally sensitive to pressure. The pathway comprises one pathway corresponding to each direction in which the pressure sensitive interface is directionally sensitive. The tactile switch further is provided with additional switch mechanisms corresponding to each pathway. Referring to FIG. 4*a*, the tactile switch (50) is provided with a pressure sensitive interface (52) which is directionally sensitive to pressure. In the Figure, the directional sensitivity is designated by arrowheads (59*a*-59*h*) on the surface of the pressure sensitive interface (52), however these are present in the Figure for merely illustrative purposes and would not necessarily be present on an actual device. The tactile switch (50) also includes pathways (54*a*-54*d*), switch mechanisms (56*a* and 56*b*) and viscous fluid (58) in the pathways. Switch mechanisms (56*a* and 56*b*) each have two possible electrical contact positions, corresponding to the four pathways (54*a*-54*d*). In FIG. 4*a*, when the pressure sensitive interface (52) is pressed in the direction of the blackened arrow head (59*a*), viscous fluid (58) flows in pathways (54*b* and 54*c*) to exert pressure on the switch mechanisms (56*a* and 56*b*) to make an electrical connection. Similarly, in other exemplary embodiments, depressing the pressure sensitive interface (52) in the (59*b*) direction results in viscous fluid (58) flow in pathway (54*c*); or in direction (59*c*) results in viscous fluid (58) flow in pathways (54*b* and 54*c*); or in the direction (59*d*) results in viscous fluid (58) flow in pathways (54*d*); or in direction (59*e*) results in viscous fluid (58) flow in pathways (54*a* and 54*d*); or in the direction (59*f*) results in viscous fluid (58) flow in pathways (54*a*); or in direction (59*g*) results in viscous fluid (58) flow in pathways (54*a* and 54*c*).

Figure 4B:
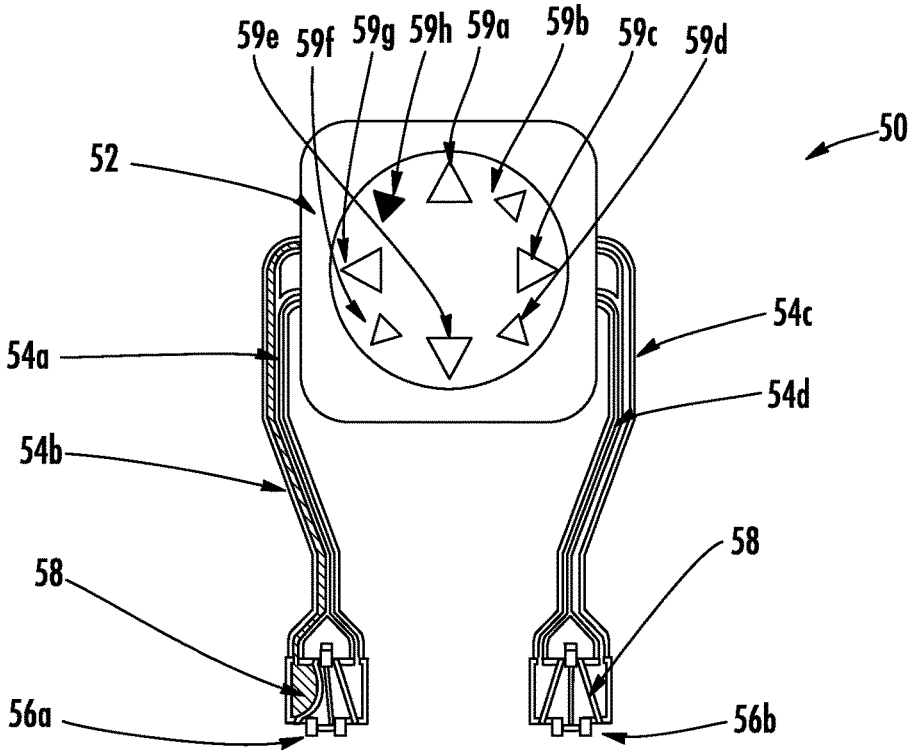

Referring now to FIG. 4*b*, in another exemplary embodiment, on the tactile switch (50), the pressure sensitive interface (52) is depressed the direction of blackened arrow head (52*h*). This depression causes viscous fluid (58) to flow through pathway (54*b*) to exert pressure on switch mechanism (56*a*) to make an electrical contact.

In another exemplary embodiment, in all the foregoing examples, the switch mechanism, when making electrical contact, activates some feature of the electronic mobile device.

The following represent additional exemplary embodiments.

Embodiment 1

A tactile switch on a mobile electronic device having a housing, comprising:

a pressure sensitive interface on an exterior portion of the housing;

a switch mechanism, the switch mechanism being at a remote location from the pressure sensitive interface;

at least one pathway coupled to the pressure sensitive interface and extending from the pressure sensitive interface to the switch mechanism, the pathway being formed in an interior portion of the housing;

a viscous fluid substantially filling the pathway; and the tactile switch being configured such that when pressure is applied to the pressure sensitive interface, the viscous fluid exerts pressure on the switch mechanism, causing the switch to make an electrical contact.

Embodiment 2

The tactile switch of Embodiment 1, wherein the switch mechanism is mechanical.

Embodiment 3

The tactile switch of Embodiment 1, wherein the switch mechanism is a solid state pressure sensor.

Embodiment 4

The tactile switch of Embodiment 1, wherein the pathway is molded into the interior portion of the housing.

Embodiment 5

The tactile switch of Embodiment 3, wherein the pressure sensitive interface is differentially sensitive to different pressures applied to the pressure sensitive interface.

Embodiment 6

The tactile switch of Embodiment 1, wherein the viscous fluid is a hydraulic fluid.

Embodiment 7

The tactile switch of Embodiment 1, wherein the pressure sensitive interface comprises more than one pressure sensitive interface; wherein the at least one pathway comprises one pathway corresponding to each pressure sensitive interface; the tactile switch further comprising additional switch mechanisms corresponding to each pressure sensitive interface.

Embodiment 8

The tactile switch of Embodiment 1, wherein the pressure sensitive interface may be located on any part of the exterior portion of the housing.

Embodiment 9

The tactile switch of Embodiment 1, wherein the pressure sensitive interface has a shape, the shape conforming to a contour of the exterior portion of the housing where the pressure sensitive interface is located.

Embodiment 10

The tactile switch of Embodiment 1, further comprising means to transmit vibration to the exterior housing when the electrical contact is made with the switch mechanism.

Embodiment 11

The tactile switch of Embodiment 10, wherein the vibration is transmitted to the pressure sensitive interface.

Embodiment 12

The tactile switch of Embodiment 10, wherein the means to transmit vibration is selected from a solenoid and a vibrator, the means being activated by the switch making the electrical contact.

Embodiment 13

The tactile switch of Embodiment 1, wherein the pathways are sealed.

Embodiment 14

The tactile switch of Embodiment 1, wherein the pressure sensitive interface is directionally sensitive to pressure, and wherein the at least one pathway comprises one pathway corresponding to each direction in which the pressure sensitive interface is directionally sensitive; the tactile switch further comprising additional switch mechanisms corresponding to each pathway.

Embodiment 15

The tactile switch of Embodiment 14, further comprising means to transmit vibrations to the exterior housing when the electrical contact is made with one of the switch mechanisms, the vibrations being varied in property depending on which switch mechanism caused the electrical contact.

Embodiment 16

The tactile switch of Embodiment 15, wherein the property is selected from amplitude and frequency.

Embodiment 17

The tactile switch of Embodiment 1, wherein the exterior portion of the housing of mobile electronic device is comprised of a resilient material; and wherein the pressure sensitive interface is comprised of the entire exterior portion of the housing.

Embodiment 18

A tactile switch on a mobile electronic device having a housing, comprising:

a pressure sensitive interface on an exterior portion of the housing;

a switch mechanism, the switch mechanism being at a remote location from the pressure sensitive interface;

means for transferring pressure from the pressure sensitive interface to the switch mechanism, such that pressure applied to the pressure sensitive interface causes the switch mechanism to make an electrical contact.

Embodiment 19

The tactile switch of 18, wherein the means for transferring pressure comprises, at least one pathway coupled to the pressure sensitive interface and extending from the pressure sensitive interface to the switch mechanism, the pathway being formed in an interior portion of the housing; and viscous fluid substantially filling the pathway.

Embodiment 20

The tactile switch of Embodiment 18, wherein the switch mechanism is mechanical.

Embodiment 21

The tactile switch of Embodiment 18, wherein the switch mechanism is a solid state pressure sensor.

Embodiment 22

The tactile switch of Embodiment 19, wherein the pathway is molded into the interior portion of the housing.

Embodiment 23

The tactile switch of Embodiment 21, wherein the pressure sensitive interface is differentially sensitive to different pressures applied to the pressure sensitive interface.

Embodiment 24

The tactile switch of Embodiment 19, wherein the viscous fluid is a hydraulic fluid.

Embodiment 25

The tactile switch of Embodiment 19, wherein the pressure sensitive interface comprises more than one pressure sensitive interface; and wherein the at least one pathway comprises one pathway corresponding to each pressure sensitive interface; the tactile switch further comprising additional switch mechanisms corresponding to each pressure sensitive interface.

Embodiment 26

The tactile switch of Embodiment 18, wherein the pressure sensitive interface may be located on any part of the exterior portion of the housing.

Embodiment 27

The tactile switch of Embodiment 18, wherein the pressure sensitive interface has a shape, the shape conforming to a contour of the exterior portion of the housing where the pressure sensitive interface is located.

Embodiment 28

The tactile switch of Embodiment 18, further comprising means to transmit vibration to the exterior housing when the electrical contact is made with the switch mechanism.

Embodiment 29

The tactile switch of Embodiment 28, wherein the vibration is transmitted to the pressure sensitive interface.

Embodiment 30

The tactile switch of Embodiment 28, wherein the means to transmit vibration is selected from a solenoid and a vibrator, the means being activated by the switch making the electrical contact.

Embodiment 31

The tactile switch of Embodiment 19, wherein the pathways are sealed.

Embodiment 32

The tactile switch of Embodiment 19, wherein the pressure sensitive interface is directionally sensitive to pressure, and wherein the at least one pathway comprises one pathway corresponding to each direction in which the pressure sensitive interface is directionally sensitive; the tactile switch further comprising additional switch mechanisms corresponding to each pathway.

Embodiment 33

The tactile switch of Embodiment 32, further comprising means to transmit vibrations to the exterior housing when the electrical contact is made by one of the switch mechanisms, the vibrations being varied in property depending on which switch mechanism caused the electrical contact.

Embodiment 34

The tactile switch of Embodiment 33, wherein the property is selected from amplitude and frequency.

Embodiment 35

The tactile switch of Embodiment 18, wherein the exterior portion of the housing of mobile electronic device is comprised of a resilient material; and wherein the pressure sensitive interface is comprised of the entire exterior portion of the housing.

Embodiment 36

The tactile switch of Embodiment 1, further comprising a reservoir containing the viscous fluid located between the pressure sensitive interface and the pathway.

Embodiment 37

The tactile switch of Embodiment 19, further comprising a reservoir containing the viscous fluid located between the pressure sensitive interface and the pathway.

To supplement the present disclosure, this application incorporates entirely by reference the following commonly assigned patents, patent application publications, and patent applications:

To supplement the present disclosure, this application incorporates entirely by reference the following patents, patent application publications, and patent applications:

U.S. Pat. No. 6,832,725; U.S. Pat. No. 7,128,266; U.S. Pat. No. 7,159,783; U.S. Pat. No. 7,413,127; U.S. Pat. No. 7,726,575; U.S. Pat. No. 8,294,969; U.S. Pat. No. 8,317,105; U.S. Pat. No. 8,322,622; U.S. Pat. No. 8,366,005; U.S. Pat. No. 8,371,507; U.S. Pat. No. 8,376,233; U.S. Pat. No. 8,381,979; U.S. Pat. No. 8,390,909; U.S. Pat. No. 8,408,464; U.S. Pat. No. 8,408,468; U.S. Pat. No. 8,408,469; U.S. Pat. No. 8,424,768; U.S. Pat. No. 8,448,863; U.S. Pat. No. 8,457,013; U.S. Pat. No. 8,459,557; U.S. Pat. No. 8,469,272; U.S. Pat. No. 8,474,712; U.S. Pat. No. 8,479,992; U.S. Pat. No. 8,490,877; U.S. Pat. No. 8,517,271; U.S. Pat. No. 8,523,076; U.S. Pat. No. 8,528,818; U.S. Pat. No. 8,544,737; U.S. Pat. No. 8,548,242; U.S. Pat. No. 8,548,420; U.S. Pat. No. 8,550,335; U.S. Pat. No. 8,550,354; U.S. Pat. No. 8,550,357; U.S. Pat. No. 8,556,174; U.S. Pat. No. 8,556,176; U.S. Pat. No. 8,556,177; U.S. Pat. No. 8,559,767; U.S. Pat. No. 8,599,957; U.S. Pat. No. 8,561,895; U.S. Pat. No. 8,561,903; U.S. Pat. No. 8,561,905; U.S. Pat. No. 8,565,107; U.S. Pat. No. 8,571,307; U.S. Pat. No. 8,579,200; U.S. Pat. No. 8,583,924; U.S. Pat. No. 8,584,945; U.S. Pat. No. 8,587,595; U.S. Pat. No. 8,587,697; U.S. Pat. No. 8,588,869; U.S. Pat. No. 8,590,789; U.S. Pat. No. 8,596,539; U.S. Pat. No. 8,596,542; U.S. Pat. No. 8,596,543; U.S. Pat. No. 8,599,271; U.S. Pat. No. 8,599,957; U.S. Pat. No. 8,600,158; U.S. Pat. No. 8,600,167; U.S. Pat. No. 8,602,309; U.S. Pat. No. 8,608,053; U.S. Pat. No. 8,608,071; U.S. Pat. No. 8,611,309; U.S. Pat. No. 8,615,487; U.S. Pat. No. 8,616,454; U.S. Pat. No. 8,621,123; U.S. Pat. No. 8,622,303; U.S. Pat. No. 8,628,013; U.S. Pat. No. 8,628,015; U.S. Pat. No. 8,628,016; U.S. Pat. No. 8,629,926; U.S. Pat. No. 8,630,491; U.S. Pat. No. 8,635,309; U.S. Pat. No. 8,636,200; U.S. Pat. No. 8,636,212; U.S. Pat. No. 8,636,215; U.S. Pat. No. 8,636,224; U.S. Pat. No. 8,638,806; U.S. Pat. No. 8,640,958; U.S. Pat. No. 8,640,960; U.S. Pat. No. 8,643,717; U.S. Pat. No. 8,646,692; U.S. Pat. No. 8,646,694; U.S. Pat. No. 8,657,200; U.S. Pat. No. 8,659,397; U.S. Pat. No. 8,668,149; U.S. Pat. No. 8,678,285; U.S. Pat. No. 8,678,286; U.S. Pat. No. 8,682,077; U.S. Pat. No. 8,687,282; U.S. Pat. No. 8,692,927; U.S. Pat. No. 8,695,880; U.S. Pat. No. 8,698,949; U.S. Pat. No. 8,717,494; U.S. Pat. No. 8,717,494; U.S. Pat. No. 8,720,783; U.S. Pat. No. 8,723,804; U.S. Pat. No. 8,723,904; U.S. Pat. No. 8,727,223; U.S. Pat. No. D702,237; U.S. Pat. No. 8,740,082; U.S. Pat. No. 8,740,085; U.S. Pat. No. 8,746,563; U.S. Pat. No. 8,750,445; U.S. Pat. No. 8,752,766; U.S. Pat. No. 8,756,059; U.S. Pat. No. 8,757,495; U.S. Pat. No. 8,760,563; U.S. Pat. No. 8,763,909; U.S. Pat. No. 8,777,108; U.S. Pat. No. 8,777,109; U.S. Pat. No. 8,779,898; U.S. Pat. No. 8,781,520; U.S. Pat. No. 8,783,573; U.S. Pat. No. 8,789,757; U.S. Pat. No. 8,789,758; U.S. Pat. No. 8,789,759; U.S. Pat. No. 8,794,520; U.S. Pat. No. 8,794,522; U.S. Pat. No. 8,794,526; U.S. Pat. No. 8,798,367; U.S. Pat. No. 8,807,431; U.S. Pat. No. 8,807,432; U.S. Pat. No. 8,820,630;

International Publication No. 2013/163789;
International Publication No. 2013/173985;
International Publication No. 2014/019130;
International Publication No. 2014/110495;

U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2011/0202554;
U.S. Patent Application Publication No. 2012/0111946;
U.S. Patent Application Publication No. 2012/0138685;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0056285;
U.S. Patent Application Publication No. 2013/0070322;
U.S. Patent Application Publication No. 2013/0075168;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0200158;
U.S. Patent Application Publication No. 2013/0256418;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0278425;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306730;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0341399;
U.S. Patent Application Publication No. 2013/0342717;
U.S. Patent Application Publication No. 2014/0001267;
U.S. Patent Application Publication No. 2014/0002828;
U.S. Patent Application Publication No. 2014/0008430;
U.S. Patent Application Publication No. 2014/0008439;
U.S. Patent Application Publication No. 2014/0025584;
U.S. Patent Application Publication No. 2014/0027518;
U.S. Patent Application Publication No. 2014/0034734;
U.S. Patent Application Publication No. 2014/0036848;

U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061305;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0075846;
U.S. Patent Application Publication No. 2014/0076974;
U.S. Patent Application Publication No. 2014/0078341;
U.S. Patent Application Publication No. 2014/0078342;
U.S. Patent Application Publication No. 2014/0078345;
U.S. Patent Application Publication No. 2014/0084068;
U.S. Patent Application Publication No. 2014/0097249;
U.S. Patent Application Publication No. 2014/0098792;
U.S. Patent Application Publication No. 2014/0100774;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0108682;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0160329;
U.S. Patent Application Publication No. 2014/0166755;
U.S. Patent Application Publication No. 2014/0166757;
U.S. Patent Application Publication No. 2014/0166759;
U.S. Patent Application Publication No. 2014/0166760;
U.S. Patent Application Publication No. 2014/0166761;
U.S. Patent Application Publication No. 2014/0168787;
U.S. Patent Application Publication No. 2014/0175165;
U.S. Patent Application Publication No. 2014/0175169;
U.S. Patent Application Publication No. 2014/0175172;
U.S. Patent Application Publication No. 2014/0175174;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0203087;
U.S. Patent Application Publication No. 2014/0204268;
U.S. Patent Application Publication No. 2014/0214631;
U.S. Patent Application Publication No. 2014/0217166;
U.S. Patent Application Publication No. 2014/0217180;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/436,337 for an Electronic Device, filed Nov. 5, 2012 (Fitch et al.);

U.S. patent application Ser. No. 13/771,508 for an Optical Redirection Adapter, filed Feb. 20, 2013 (Anderson);

U.S. patent application Ser. No. 13/852,097 for a System and Method for Capturing and Preserving Vehicle Event Data, filed Mar. 28, 2013 (Barker et al.);

U.S. patent application Ser. No. 13/902,110 for a System and Method for Display of Information Using a Vehicle-Mount Computer, filed May 24, 2013 (Hollifield);

U.S. patent application Ser. No. 13/902,144, for a System and Method for Display of Information Using a Vehicle-Mount Computer, filed May 24, 2013 (Chamberlin);

U.S. patent application Ser. No. 13/902,242 for a System For Providing A Continuous Communication Link With A Symbol Reading Device, filed May 24, 2013 (Smith et al.);

U.S. patent application Ser. No. 13/912,262 for a Method of Error Correction for 3D Imaging Device, filed Jun. 7, 2013 (Jovanovski et al.);

U.S. patent application Ser. No. 13/912,702 for a System and Method for Reading Code Symbols at Long Range Using Source Power Control, filed Jun. 7, 2013 (Xian et al.);

U.S. patent application Ser. No. 29/458,405 for an Electronic Device, filed Jun. 19, 2013 (Fitch et al.);

U.S. patent application Ser. No. 13/922,339 for a System and Method for Reading Code Symbols Using a Variable Field of View, filed Jun. 20, 2013 (Xian et al.);

U.S. patent application Ser. No. 13/927,398 for a Code Symbol Reading System Having Adaptive Autofocus, filed Jun. 26, 2013 (Todeschini);

U.S. patent application Ser. No. 13/930,913 for a Mobile Device Having an Improved User Interface for Reading Code Symbols, filed Jun. 28, 2013 (Gelay et al.);

U.S. patent application Ser. No. 29/459,620 for an Electronic Device Enclosure, filed Jul. 2, 2013 (London et al.);

U.S. patent application Ser. No. 29/459,681 for an Electronic Device Enclosure, filed Jul. 2, 2013 (Chaney et al.);

U.S. patent application Ser. No. 13/933,415 for an Electronic Device Case, filed Jul. 2, 2013 (London et al.);

U.S. patent application Ser. No. 29/459,785 for a Scanner and Charging Base, filed Jul. 3, 2013 (Fitch et al.);

U.S. patent application Ser. No. 29/459,823 for a Scanner, filed Jul. 3, 2013 (Zhou et al.);

U.S. patent application Ser. No. 13/947,296 for a System and Method for Selectively Reading Code Symbols, filed Jul. 22, 2013 (Rueblinger et al.);

U.S. patent application Ser. No. 13/950,544 for a Code Symbol Reading System Having Adjustable Object Detection, filed Jul. 25, 2013 (Jiang);

U.S. patent application Ser. No. 13/961,408 for a Method for Manufacturing Laser Scanners, filed Aug. 7, 2013 (Saber et al.);

U.S. patent application Ser. No. 14/018,729 for a Method for Operating a Laser Scanner, filed Sep. 5, 2013 (Feng et al.);

U.S. patent application Ser. No. 14/019,616 for a Device Having Light Source to Reduce Surface Pathogens, filed Sep. 6, 2013 (Todeschini);

U.S. patent application Ser. No. 14/023,762 for a Handheld Indicia Reader Having Locking Endcap, filed Sep. 11, 2013 (Gannon);

U.S. patent application Ser. No. 14/035,474 for Augmented-Reality Signature Capture, filed Sep. 24, 2013 (Todeschini);

U.S. patent application Ser. No. 29/468,118 for an Electronic Device Case, filed Sep. 26, 2013 (Oberpriller et al.);

U.S. patent application Ser. No. 14/055,234 for Dimensioning System, filed Oct. 16, 2013 (Fletcher);

U.S. patent application Ser. No. 14/053,314 for Indicia Reader, filed Oct. 14, 2013 (Huck);

U.S. patent application Ser. No. 14/065,768 for Hybrid System and Method for Reading Indicia, filed Oct. 29, 2013 (Meier et al.);

U.S. patent application Ser. No. 14/074,746 for Self-Checkout Shopping System, filed Nov. 8, 2013 (Hejl et al.);

U.S. patent application Ser. No. 14/074,787 for Method and System for Configuring Mobile Devices via NFC Technology, filed Nov. 8, 2013 (Smith et al.);

U.S. patent application Ser. No. 14/087,190 for Optimal Range Indicators for Bar Code Validation, filed Nov. 22, 2013 (Hejl);

U.S. patent application Ser. No. 14/094,087 for Method and System for Communicating Information in an Digital Signal, filed Dec. 2, 2013 (Peake et al.);

U.S. patent application Ser. No. 14/101,965 for High Dynamic-Range Indicia Reading System, filed Dec. 10, 2013 (Xian);

U.S. patent application Ser. No. 14/150,393 for Indicia-reader Having Unitary Construction Scanner, filed Jan. 8, 2014 (Colavito et al.);

U.S. patent application Ser. No. 14/154,207 for Laser Barcode Scanner, filed Jan. 14, 2014 (Hou et al.);

U.S. patent application Ser. No. 14/165,980 for System and Method for Measuring Irregular Objects with a Single Camera filed Jan. 28, 2014 (Li et al.);

U.S. patent application Ser. No. 14/166,103 for Indicia Reading Terminal Including Optical Filter filed Jan. 28, 2014 (Lu et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 14/250,923 for Reading Apparatus Having Partial Frame Operating Mode filed Apr. 11, 2014, (Deng et al.);

U.S. patent application Ser. No. 14/257,174 for Imaging Terminal Having Data Compression filed Apr. 21, 2014, (Barber et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/274,858 for Mobile Printer with Optional Battery Accessory filed May 12, 2014 (Marty et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/300,276 for METHOD AND SYSTEM FOR CONSIDERING INFORMATION ABOUT AN EXPECTED RESPONSE WHEN PERFORMING SPEECH RECOGNITION, filed Jun. 10, 2014 (Braho et al.);

U.S. patent application Ser. No. 14/305,153 for INDICIA READING SYSTEM EMPLOYING DIGITAL GAIN CONTROL filed Jun. 16, 2014 (Xian et al.);

U.S. patent application Ser. No. 14/310,226 for AUTOFOCUSING OPTICAL IMAGING DEVICE filed Jun. 20, 2014 (Koziol et al.);

U.S. patent application Ser. No. 14/327,722 for CUSTOMER FACING IMAGING SYSTEMS AND METHODS FOR OBTAINING IMAGES filed Jul. 10, 2014 (Oberpriller et al);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/329,303 for CELL PHONE READING MODE USING IMAGE TIMER filed Jul. 11, 2014 (Coyle);

U.S. patent application Ser. No. 14/333,588 for SYMBOL READING SYSTEM WITH INTEGRATED SCALE BASE filed Jul. 17, 2014 (Barten);

U.S. patent application Ser. No. 14/334,934 for a SYSTEM AND METHOD FOR INDICIA VERIFICATION, filed Jul. 18, 2014 (Hejl);

U.S. patent application Ser. No. 14/336,188 for METHOD OF AND SYSTEM FOR DETECTING OBJECT WEIGHING INTERFERENCES, Filed Jul. 21, 2014 (Amundsen et al.);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/340,716 for an OPTICAL IMAGER AND METHOD FOR CORRELATING A MEDICATION PACKAGE WITH A PATIENT, filed Jul. 25, 2014 (Ellis);

U.S. patent application Ser. No. 14/342,544 for Imaging Based Barcode Scanner Engine with Multiple Elements Supported on a Common Printed Circuit Board filed Mar. 4, 2014 (Liu et al.);

U.S. patent application Ser. No. 14/345,735 for Optical Indicia Reading Terminal with Combined Illumination filed Mar. 19, 2014 (Ouyang);

U.S. patent application Ser. No. 14/336,188 for METHOD OF AND SYSTEM FOR DETECTING OBJECT WEIGHING INTERFERENCES, Filed Jul. 21, 2014 (Amundsen et al.);

U.S. patent application Ser. No. 14/355,613 for Optical Indicia Reading Terminal with Color Image Sensor filed May 1, 2014 (Lu et al.);

U.S. patent application Ser. No. 14/370,237 for WEB-BASED SCAN-TASK ENABLED SYSTEM AND METHOD OF AND APPARATUS FOR DEVELOPING AND DEPLOYING THE SAME ON A CLIENT-SERVER NETWORK filed Jul. 2, 2014 (Chen et al.);

U.S. patent application Ser. No. 14/370,267 for INDUSTRIAL DESIGN FOR CONSUMER DEVICE BASED SCANNING AND MOBILITY, filed Jul. 2, 2014 (Ma et al.);

U.S. patent application Ser. No. 14/376,472, for an ENCODED INFORMATION READING TERMINAL INCLUDING HTTP SERVER, filed Aug. 4, 2014 (Lu);

U.S. patent application Ser. No. 14/379,057 for METHOD OF USING CAMERA SENSOR INTERFACE TO TRANSFER MULTIPLE CHANNELS OF SCAN DATA USING AN IMAGE FORMAT filed Aug. 15, 2014 (Wang et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/460,387 for APPARATUS FOR DISPLAYING BAR CODES FROM LIGHT EMITTING DISPLAY SURFACES filed Aug. 15, 2014 (Van Horn et al.);

U.S. patent application Ser. No. 14/460,829 for ENCODED INFORMATION READING TERMINAL WITH WIRELESS PATH SELECTON CAPABILITY, filed Aug. 15, 2014 (Wang et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/446,387 for INDICIA READING TERMINAL PROCESSING PLURALITY OF FRAMES OF IMAGE DATA RESPONSIVELY TO TRIGGER SIGNAL ACTIVATION filed Jul. 30, 2014 (Wang et al.);

U.S. patent application Ser. No. 14/446,391 for MULTIFUNCTION POINT OF SALE APPARATUS WITH OPTICAL SIGNATURE CAPTURE filed Jul. 30, 2014 (Good et al.);

U.S. patent application Ser. No. 29/486,759 for an Imaging Terminal, filed Apr. 2, 2014 (Oberpriller et al.);

U.S. patent application Ser. No. 29/492,903 for an INDICIA SCANNER, filed Jun. 4, 2014 (Zhou et al.); and U.S. patent application Ser. No. 29/494,725 for an INCOUNTER BARCODE SCANNER, filed Jun. 24, 2014 (Oberpriller et al.).

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A tactile switch on a mobile electronic device having a housing, comprising:

a pressure sensitive interface on an exterior portion of the housing;

a switch mechanism, the switch mechanism being at a remote location from the pressure sensitive interface;

at least one pathway coupled to the pressure sensitive interface and extending from the pressure sensitive interface to the switch mechanism, the pathway being formed in an interior portion of the housing;

a viscous fluid substantially filling the at least one pathway; and a vibration device mechanically coupled to the at least one pathway;

the tactile switch being configured such that when pressure is applied to the pressure sensitive interface, the viscous fluid exerts pressure on the switch mechanism, causing the switch to make an electrical contact; and wherein the vibration device transmits vibration to the pressure sensitive interface via the viscous fluid when the switch mechanism makes the electrical contact.

2. The tactile switch of claim 1, wherein the switch mechanism is mechanical.

3. The tactile switch of claim 1, wherein the at least one pathway is molded into the interior portion of the housing.

4. The tactile switch of claim 1, wherein the viscous fluid is a hydraulic fluid.

5. The tactile switch of claim 1, wherein the pressure sensitive interface comprises more than one pressure sensitive interface; wherein the at least one pathway comprises one pathway corresponding to each pressure sensitive interface; the tactile switch further comprising additional switch mechanisms corresponding to each pressure sensitive interface.

6. The tactile switch of claim 1, wherein the pressure sensitive interface has a shape, the shape conforming to a contour of the exterior portion of the housing where the pressure sensitive interface is located.

7. The tactile switch of claim 1, wherein the pressure sensitive interface comprises a first portion coupled to a first pathway of the at least on pathway and a second portion coupled to a second pathway of the at least one pathway, and wherein the vibration device transmits vibration to the first portion via the viscous fluid in the first pathway upon the first portion being pressed and to the second portion via the viscous fluid in the second pathway upon the second portion being pressed when the electrical contact is made with the switch mechanism.

8. The tactile switch of claim 7, wherein the vibration is transmitted to the pressure sensitive interface at a first frequency and/or a first amplitude upon pressure being applied to the first portion and at a second frequency and/or a second amplitude upon pressure being applied to the second portion.

9. The tactile switch of claim 1, wherein the vibration device is selected from a solenoid and a vibrator.

10. The tactile switch of claim 1, wherein the switch mechanism is a solid state pressure sensor.

11. The tactile switch of claim 10, wherein the pressure sensitive interface is differentially sensitive to different pressures applied to the pressure sensitive interface.

12. A tactile switch on a mobile electronic device having a housing, comprising:

a pressure sensitive interface on an exterior portion of the housing, the pressure sensitive interface comprising a first portion and a second portion;

a switch mechanism, the switch mechanism being at a remote location from the pressure sensitive interface;

a first pathway substantially filled with viscous fluid, the first pathway coupled to the first portion of the pressure sensitive interface and extending from the first portion to the switch mechanism, and a second pathway substantially filled with viscous fluid, the second pathway coupled to the second portion of the pressure sensitive interface and extending from the second portion to the switch mechanism;

a first vibration device mechanically coupled to the first pathway, the first vibration device configured to transmit vibration to the first portion of the pressure sensitive interface via the first pathway in response to pressure applied to the first portion, and a second vibration device mechanically coupled to the second pathway, the second vibration device configured to transmit vibration to the second portion of the pressure sensitive interface via the second pathway in response to pressure applied to the second portion;

wherein pressure applied to the pressure sensitive interface causes the switch mechanism to make an electrical contact.

13. The tactile switch of claim 12, wherein the switch mechanism is mechanical.

14. The tactile switch of claim 12, wherein the switch mechanism is a solid state pressure sensor.

15. The tactile switch of claim 12, wherein the first pathway and/or the second pathway is molded into an interior portion of the housing.

16. The tactile switch of claim 12, wherein the pressure sensitive interface is directionally sensitive to different pressures applied to the pressure sensitive interface, the first pathway corresponding to a first direction of pressure applied to the pressure sensitive interface and the second pathway corresponding to a second direction of pressure applied to the pressure sensitive interface.

17. The tactile switch of claim 12, wherein the viscous fluid is a hydraulic fluid.

18. The tactile switch of claim 12, wherein the pressure sensitive interface comprises more than one pressure sensitive interface; and wherein the at least one pathway comprises one pathway corresponding to each pressure sensitive interface; the tactile switch further comprising additional switch mechanisms corresponding to each pressure sensitive interface.

19. The tactile switch of claim 12, wherein the first vibration device transmits vibration to the first portion of the pressure sensitive interface when pressure applied to the first portion causes the switch mechanism to make the electrical contact and/or the second vibration device transmits vibration to the second portion of the pressure sensitive interface when pressure applied to the second portion causes the switch mechanism to make the electrical contact.

20. The tactile switch of claim 12, wherein the vibration is transmitted to the pressure sensitive interface at a first frequency and/or a first amplitude upon pressure being applied to the first portion and at a second frequency and/or a second amplitude upon pressure being applied to the second portion.

* * * * *